US006863246B2

(12) United States Patent
Kane et al.

(10) Patent No.: US 6,863,246 B2
(45) Date of Patent: Mar. 8, 2005

(54) METHOD AND SYSTEM FOR AUTOMATED FAULT REPORTING

(75) Inventors: Mark Edward Kane, Orange Park, FL (US); James Francis Shockley, Orange Park, FL (US); Harrison Thomas Hickenlooper, Palatka, FL (US)

(73) Assignee: Quantum Engineering, Inc., Orange Park, FL (US)

( * ) Notice: Subject to any disclaimer, the term of this patent is extended or adjusted under 35 U.S.C. 154(b) by 0 days.

(21) Appl. No.: 10/331,768

(22) Filed: Dec. 31, 2002

(65) Prior Publication Data

US 2004/0124315 A1 Jul. 1, 2004

(51) Int. Cl.[7] ..... B61C 17/00
(52) U.S. Cl. ..... 246/121; 701/19
(58) Field of Search ..... 246/1.8, 119, 120, 246/121, 122 R, 182 R; 701/19

(56) References Cited

U.S. PATENT DOCUMENTS

| | | | | |
|---|---|---|---|---|
| 4,181,943 A | | 1/1980 | Mercer, Sr. et al. | |
| 4,459,668 A | | 7/1984 | Inoue et al. | |
| 4,561,057 A | | 12/1985 | Haley, Jr. et al. | |
| 4,711,418 A | | 12/1987 | Aver, Jr. et al. | |
| 5,026,009 A | * | 6/1991 | Milnes | 246/122 R |
| 5,072,900 A | | 12/1991 | Malon | |
| 5,129,605 A | | 7/1992 | Burns et al. | |
| 5,177,685 A | | 1/1993 | Davis et al. | |
| 5,332,180 A | | 7/1994 | Peterson et al. | |
| 5,340,062 A | | 8/1994 | Heggestad | |
| 5,364,047 A | | 11/1994 | Petit et al. | |
| 5,394,333 A | | 2/1995 | Kao | |
| 5,398,894 A | | 3/1995 | Pascoe | |
| 5,452,870 A | | 9/1995 | Heggestad | |
| 5,533,695 A | | 7/1996 | Heggestad et al. | |
| 5,620,155 A | | 4/1997 | Michalek | |
| 5,699,986 A | | 12/1997 | Welk | |
| 5,740,547 A | * | 4/1998 | Kull et al. | 701/19 |
| 5,751,569 A | | 5/1998 | Metel et al. | |
| 5,803,411 A | | 9/1998 | Ackerman et al. | |
| 5,828,979 A | | 10/1998 | Polivka et al. | |
| 5,867,122 A | | 2/1999 | Zahm et al. | |

(List continued on next page.)

OTHER PUBLICATIONS

"Testimony of Jolene M. Molitoris, Federal Railroad Administrator, U.S. Department of Transportation before the House Committee on Transportation and Infrastructure Subcommittee on Railroads", Federal Railroad Administration, United States Department of Transportation, Apr. 1, 1998.

"System Architecture, ATCS Specification 100", May 1995.

"A New World for Communications & Signaling", Progressive Railroading, May 1986.

"Advanced Train Control Gain Momentum", Progressive Railroading, Mar. 1986.

(List continued on next page.)

*Primary Examiner*—Mark T. Le
(74) *Attorney, Agent, or Firm*—Steven B. Kelber; DLA Piper Rudnick; Gray Cary US LLP

(57) ABSTRACT

An automated fault reporting system for a train includes a controller that gathers information concerning malfunctioning wayside status devices and automatically reports the information to an appropriate party. In one embodiment, the control module uses a positioning system and a database including device locations in order to determine when the train is near a device. If no status information is received from the device as the train approaches, or the status information indicates a problem, the train is allowed to continue at a reduced speed to allow the operator to visually confirm that it is safe to proceed. If an area monitored by the device has been passed, or if the operator indicates that there is no problem, or the device fails to respond, the controller records and reports the malfunction.

36 Claims, 3 Drawing Sheets

U.S. PATENT DOCUMENTS

| | | | | | |
|---|---|---|---|---|---|
| 5,944,768 | A | | 8/1999 | Ito et al. | |
| 5,950,966 | A | | 9/1999 | Hungate et al. | |
| 5,956,664 | A | * | 9/1999 | Bryan | 702/184 |
| 5,978,718 | A | | 11/1999 | Kull | |
| 5,995,881 | A | | 11/1999 | Kull | |
| 6,049,745 | A | | 4/2000 | Douglas et al. | |
| 6,081,769 | A | | 6/2000 | Curtis | |
| 6,102,340 | A | | 8/2000 | Peek et al. | |
| 6,135,396 | A | | 10/2000 | Whitfield et al. | |
| 6,179,252 | B1 | | 1/2001 | Roop et al. | |
| 6,218,961 | B1 | | 4/2001 | Gross et al. | |
| 6,311,109 | B1 | | 10/2001 | Hawthorne et al. | |
| 6,322,025 | B1 | | 11/2001 | Colbert et al. | |
| 6,345,233 | B1 | | 2/2002 | Erick | |
| 6,371,416 | B1 | | 4/2002 | Hawthorne | |
| 6,373,403 | B1 | | 4/2002 | Korver et al. | |
| 6,374,184 | B1 | | 4/2002 | Zahm et al. | |
| 6,377,877 | B1 | | 4/2002 | Doner | |
| 6,397,147 | B1 | | 5/2002 | Whitehead | |
| 6,421,587 | B2 | | 7/2002 | Diana et al. | |
| 6,434,452 | B1 | * | 8/2002 | Gray | 701/19 |
| 6,456,937 | B1 | | 9/2002 | Doner et al. | |
| 6,459,964 | B1 | | 10/2002 | Vu et al. | |
| 6,459,965 | B1 | | 10/2002 | Polivka et al. | |
| 6,487,478 | B1 | | 11/2002 | Azzaro et al. | |
| 2001/0056544 | A1 | | 12/2001 | Walker | |
| 2002/0070879 | A1 | | 6/2002 | Gazit et al. | |
| 2004/0006413 | A1 | * | 1/2004 | Kane et al. | 701/19 |

OTHER PUBLICATIONS

"Railroads Take High Tech in Stride", Progressive Railroading, May 1985.
Lyle, Denise, "Positive Train Control on CSXT", Railway Fuel and Operating Officers Association, Annual Proceedings, 2000.
Lindsey, Ron A., "C B T M, Communications Based Train Management", Railway Fuel and Operating Officers Association, Annual Proceedings, 1999.
Moody, Howard G, "Advanced Train Control Systems A System to Manage Railroad Operations", Railway Fuel and Operating Officers Association, Annual Proceedings, 1993.
Ruegg, G.A., "Advanced Train Control Systems ATCS", Railway Fuel and Operating Officers Association, Annual Proceedings, 1986.
Malone, Frank, "The Gaps Start to Close"Progressive Railroading, May 1987.
"On the Threshold of ATCS", Progressive Railroading, Dec. 1987.
"CP Advances in Train Control", Progressive Railroading, Sep. 1987.
"Communications/Signaling: Vital for dramatic railroad advances", Progressive Railroading, May 1988.
"ATCS's System Engineer", Progressive Railroading, Jul. 1988.
"The Electronic Railroad Emerges", Progressive Railroading, May 1989.
"$C^3$ Comes to the Railroads", Progressive Railroading, Sep. 1989.
"ATCS on Verge of Implementation", Progressive Railroading, Dec. 1989.
"ATCS Evolving on Railroads", Progressive Railroading, Dec. 1992.
"High Tech Advances Keep Railroads Rolling", Progressive Railroading, May 1994.
"FRA Promotes Technology to Avoid Train–To–Train Collisions", Progressive Railroading, Aug. 1994.
"ATCS Moving slowly but Steadily from Lab for Field", Progressive Railroading, Dec. 1994.
Judge, T., "Electronic Advances Keeping Railroads Rolling", Progressive Railroading, Jun. 1995.
"Electronic Advances Improve How Railroads Manage", Progressive Railroading, Dec. 1995.
Judge, T., "BNSF/UP PTS Pilot Advances in Northwest", Progressive Railroading, May 1996.
Foran, P., "Train Control Quandary, Is CBTC viable? Railroads, Suppliers Hope Pilot Projects Provide Clues", Progressive Railroading, Jun. 1997.
"PTS Would've Prevented Silver Spring Crash: NTSB", Progressive Railroading, Jul. 1997.
Foran, P., "A 'Positive' Answer to the Interoperability Call", Progressive Railroading, Sep. 1997.
Foran, P., "How Safe is Safe Enough?", Progressive Railroading, Oct. 1997.
Foran, P., "A Controlling Interest In Interoperability", Progressive Railroading, Apr. 1998.
Derocher, Robert J., "Transit Projects Setting Pace for Train Control", Progressive Railroading, Jun. 1998.
Kube, K., "Variations on a Theme", Progressive Railroading, Dec. 2001.
Kube, K., "Innovation in Inches", Progressive Railroading, Feb. 2002.
Vantuono, W., "New York Leads a Revolution", Railway Age, Sep. 1996.
Vantuono, W., "Do you know where your train is?", Railway Age, Feb. 1996.
Gallamore, R., "The Curtain Rises on the Next Generation", Railway Age, Jul. 1998.
Burke, J., "How R&D is Shaping the 21st Century Railroad", Railway Age, Aug. 1998.
Vantuono, W., "CBTC: A Maturing Technology", Third International Conference On Communications Based Train Control, Railway Age, Jun. 1999.
Sullivan, T., "PTC—Is FRA Pushing Too Hard?", Railway Age, Aug. 1999.
Sullivan, T., "PTC: A Maturing Technology", Railway Age, Apr. 2000.
Moore, W., "How CBTC Can Increase Capacity", Railway Age, Apr. 2001.
Vantuono, W., "CBTC: The Jury is Still Out", Railway Age, Jun. 2001.
Vantuono, W., "New–tech Train Control Takes Off", Railway Age, May 2002.
Union Switch & Signal Intermittent Cab Signal, Bulletin 53, 1998.
GE Harris Product Sheet: "Advanced Systems for Optimizing Rail Performance" and "Advanced Products for Optimizing train Performance", undated.
GE Harris Product Sheet: "Advanced, Satellite–Based Warning System Enhances Operating Safety", undated.
Furman, E., et al., "Keeping Track of RF", GPS World, Feb. 2001.
Department of Transportation Federal Railroad Administration, Federal Register, vol. 66, No. 155, pp. 42352–42396, Aug. 10, 2001.

* cited by examiner

METHOD AND SYSTEM FOR AUTOMATED FAULT REPORTING

BACKGROUND OF THE INVENTION

1. Field of the Invention

The invention relates to railroads generally, and more particularly to a method and system for automatically reporting faults in wayside devices.

2. Discussion of the Background

Train safety has long been a concern in the railroad industry. This concern has led to proposals for and development of automated, safety-enhancing systems including Cab Signaling Systems, Automatic Train Control Systems (ATC), and a Positive Train Control (PTC) System known as the TRAIN SENTINEL™ system available from the assignee of the present application, Quantum Engineering, Inc.

These automatic systems vary in their implementation. However, one aspect shared by several of these systems is the use of wayside devices that electronically transmit status information to either a train or a centralized train control authority such as a dispatcher. In some systems, the devices transmit the status information upon receiving an interrogation signal from an approaching train. In other systems, the devices include or are connected to some apparatus (e.g., a track circuit or radar detector) that detects the presence of an approaching train and transmit the status information when the oncoming train is detected. In yet other systems, the devices automatically transmit the status information continuously or periodically regardless of whether a train is approaching. Examples of such devices are wayside signals (which are used in system such as Automatic Block Signaling systems to inform a train as to how to proceed), switches, crossing gates, track occupancy circuits, broken rail detection circuits, avalanche detection circuits, and bridge/track alignment circuits. These devices generally include at least a transmitter to transmit the status information and, in cases where the devices respond to an interrogation signal, a transceiver. The transmitter or transceiver is often, but not necessarily, radio frequency. These devices may or may not include a visual indication (e.g., one or more color signal lights) of the status information. Such devices shall be referred to herein as "wayside status devices."

Many of these systems depend upon the electronically-transmitted status information from wayside status devices rather than any visual indication of status. Furthermore, many of these systems are fail-safe in that some sort of special procedure must be performed in order for the train to pass a wayside status device if a "good" status information signal is not received from the wayside status device. For example, some versions of the TRAIN SENTINEL™ system will allow an engineer/operator to pass a switch at a very slow speed so that the engineer/operator can visually confirm that the switch is in the correct position when the electronically transmitted status information from the switch indicates that the switch is in the wrong position. Those of skill in the art will recognize that a wide range of other types of such special procedures are possible. However, regardless of the type of special procedure, it will invariably involve additional time, which increases cost.

Because of the importance of the electronically-transmitted status information in such systems, it is important that wayside status devices function properly. Hence, it is important that malfunctions in wayside status devices be reported as soon as possible so the malfunctions can be repaired as soon as possible to avoid wasting time.

What is needed is a method and apparatus that facilitates the report of malfunctioning wayside status devices.

SUMMARY OF THE INVENTION

The present invention meets the aforementioned need to a great extent by providing a computerized train control system in which a control module gathers maintenance information concerning malfunctioning wayside status devices and automatically reports the maintenance information to an appropriate party. In one embodiment of the invention, the control module uses a positioning system such as a global positioning system and a database including locations of devices in order to determine when the train is near a device. If no status information is received from a wayside status device as a train approaches the device, or the status information transmitted by the device indicates a problem, the train is allowed to continue at a reduced speed to allow the engineer/operator to visually confirm that it is safe for the train to proceed. If the track or device monitored by the wayside status device has been successfully passed, or if the engineer/operator indicates that the track or device monitored by the wayside status device is not a problem, or the wayside status device fails to respond, the control module automatically records a malfunction and reports the malfunction. In highly preferred embodiments, the control module directly reports the malfunction to a central authority such as a dispatcher. Other methods of reporting the malfunction information are used in other embodiments.

BRIEF DESCRIPTION OF THE DRAWINGS

A more complete appreciation of the invention and many of the attendant features and advantages thereof will be readily obtained as the same become better understood by reference to the following detailed description when considered in connection with the accompanying drawings, wherein.

DETAILED DESCRIPTION

The present invention will be discussed with reference to preferred embodiments of train control systems. Specific details, such as specific algorithms and hardware, are set forth in order to provide a thorough understanding of the present invention. The preferred embodiments discussed herein should not be understood to limit the invention. Furthermore, for ease of understanding, certain method steps are delineated as separate steps; however, these steps should not be construed as necessarily distinct nor order dependent in their performance.

Figure 1:
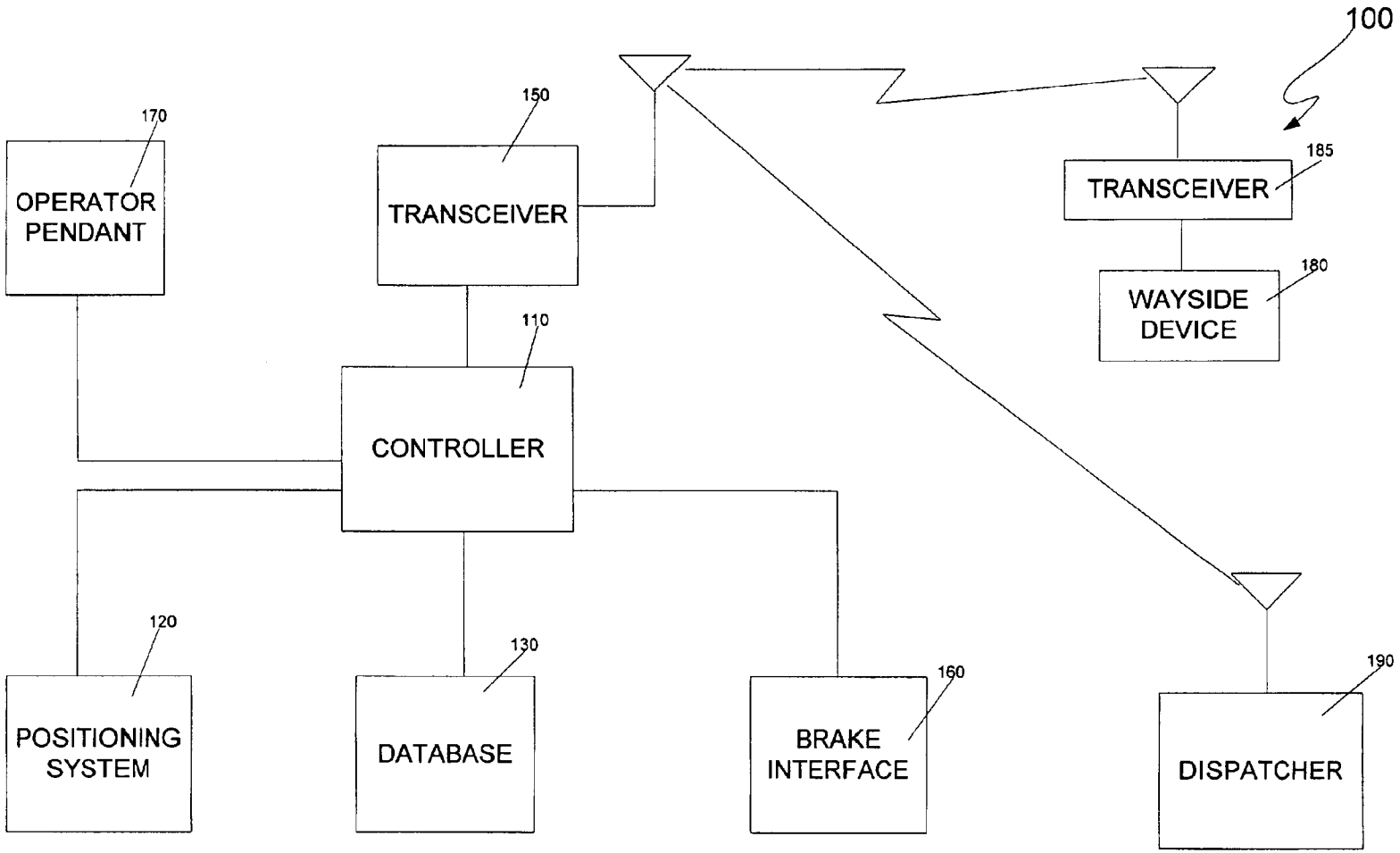
FIG. 1 is a logical block diagram of a train control system according to one embodiment of the invention.

Referring now to the drawings, wherein like reference numerals designate identical or corresponding parts throughout the several views, FIG. 1 is a logical block diagram of a train control system 100 according to an embodiment of the present invention. The system 100 includes a control module 110, which typically, but not necessarily, includes a microprocessor. The control module 110 is responsible for controlling the other components of the system.

A positioning system 120 is connected to the control module 110. The positioning system supplies the position (and, in some cases, the speed) of the train to the control module 110. The positioning system 120 can be of any type, including a global positioning system (GPS), a differential GPS, an inertial navigation system (INS), or a Loran system. Such positioning systems are well known in the art and will not be discussed in further detail herein. (As used herein, the term "positioning system" refers to the portion of a positioning system that is commonly located on a mobile vehicle, which may or may not comprise the entire system. Thus, for example, in connection with a global positioning system, the term "positioning system" as used herein refers to a GPS receiver and does not include the satellites that transmit information to the GPS receiver.)

A map database 130 is also connected to the control module 110. The map database 130 preferably comprises a non-volatile memory such as a hard disk, flash memory, CD-ROM or other storage device, on which map data is stored. Other types of memory, including volatile memory, may also be used. The map data preferably includes positions of all wayside status devices in the railroad. The map data preferably also includes information concerning the direction and grade of the track in the railway. By using train position information obtained from the positioning system 120 and the map database 130, the control module 110 can determine its position relative to wayside status devices.

When the control module 110 determines that a wayside status device 180 (which includes a transceiver 185) is present, it interrogates the device 180 through transceiver 150. The transceiver 150 can be configured for any type of communication, including communicating through rails and wireless. In addition to communicating with wayside status devices 180, the transceiver 150 is also preferably capable of communicating with one or more dispatchers 190.

Also connected to the control module 110 is a brake interface 160. The brake interface 160 monitors the train brakes and allows the control module 110 to activate and control the brakes to stop or slow the train when necessary.

An operator pendant 170 is also connected to the control module 110. The pendant 170 is used to warn the conductor/engineer that a malfunction has been detected. The pendant 170 may take the form of the operator display illustrated in co-pending U.S. application Ser. No. 10/186,426, entitled "Train Control System and Method of Controlling a Train or Trains" filed Jul. 2, 2002, the contents of which are hereby incorporated by reference herein. In such a pendant, the warning may be provided by a button that illuminates when a malfunction is detected. The pendant 170 may also be used to allow the engineer/conductor to acknowledge the warning. In yet other embodiments (e.g., those in which no acknowledgment of a warning is required), the warning device 170 may comprise or consist of a stand-alone button, or a horn or other device capable of providing an audible warning.

Figure 2A:
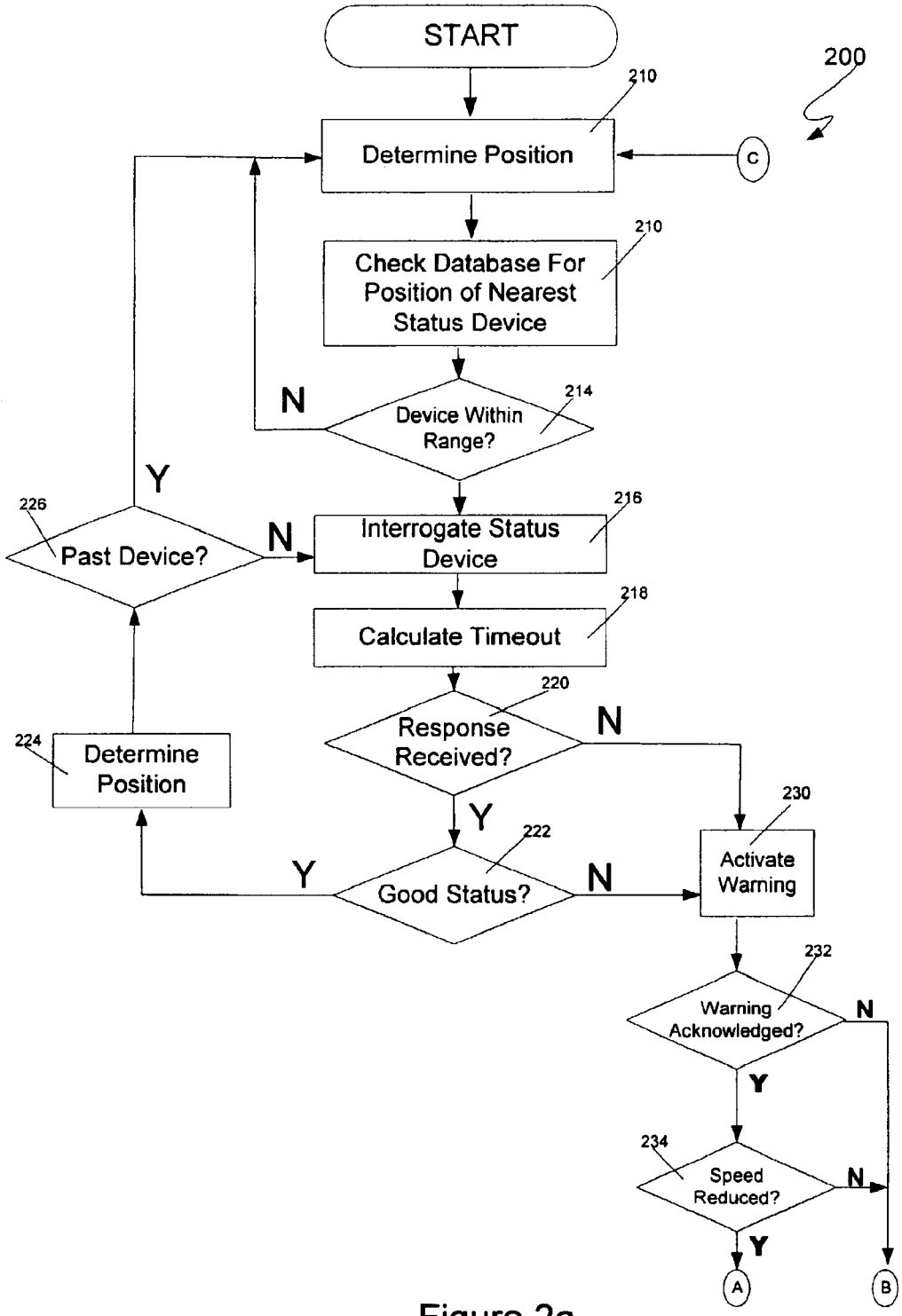
FIGS. 2(*a*) and (*b*) together comprise a flow chart of an automatic fault reporting method performed by the system of FIG. 1.
Figure 2B:
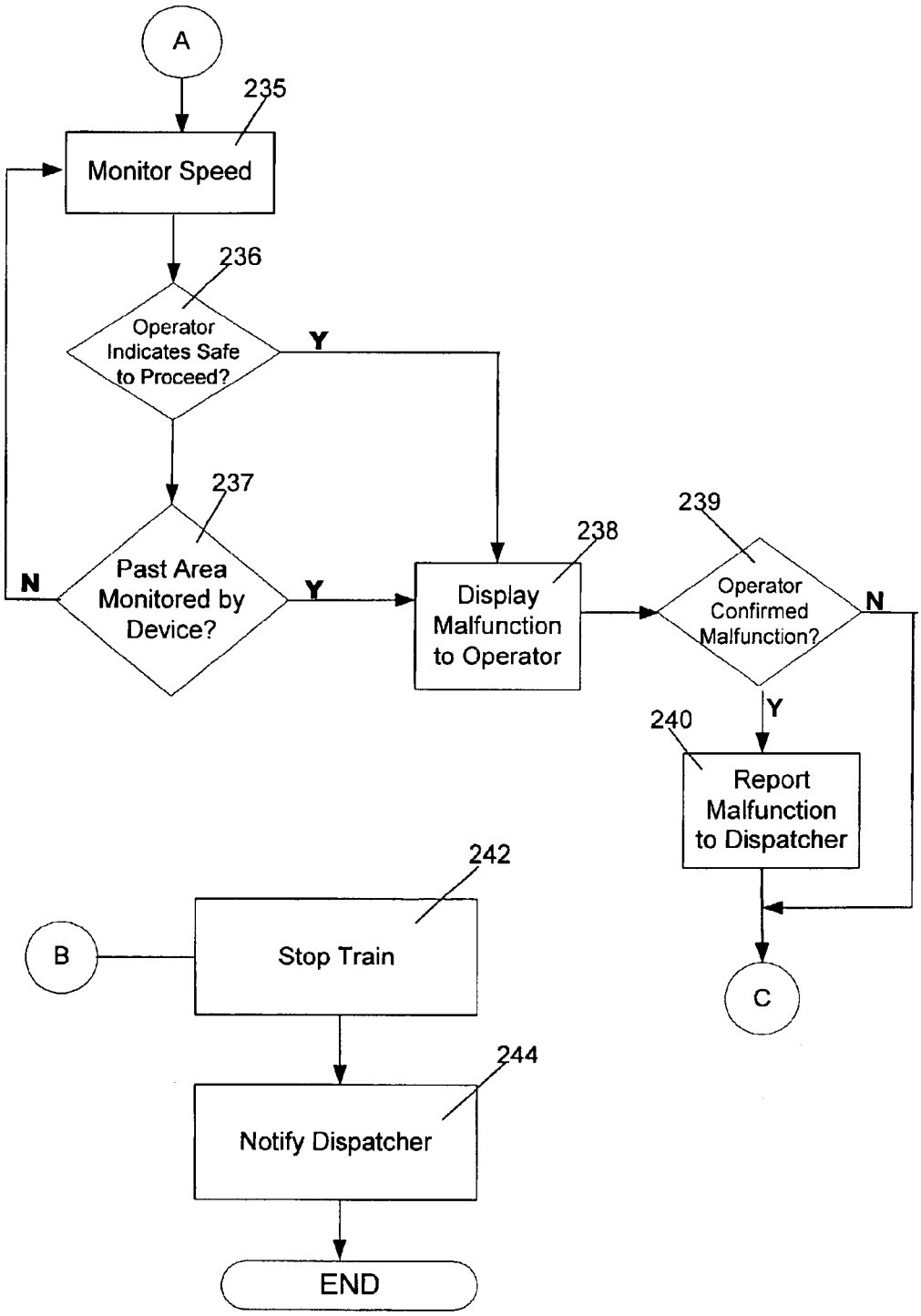

FIG. 2 is a flowchart 200 illustrating operation of the processor 110 in connection with wayside status devices 180. The control module 110 determines the train's current position from information provided by the positioning system at step 210. The control module then obtains the locations of nearby wayside status devices 180 from the map database 130 at step 212. If no wayside status device 180 is within a threshold distance and/or a time of arrival at step 214, steps 210 et seq. are repeated. If a wayside status device 180 is within a threshold distance at step 214, the device is interrogated at step 216. The threshold distance can be based upon the maximum range of the method of communication between the train and the wayside status device 180.

In some embodiments, the interrogation includes an identification number associated with the device 180. This identification number can be obtained from the map database 130 or by other methods. Since only the device corresponding to the identification number will respond to the interrogation, contention between multiple devices attempting to respond to the interrogation on the same frequency is avoided.

A timeout period is then calculated at step 218. The timeout period represents a period of time in which the wayside status device 180 must respond to the interrogation signal. The timeout period may be a predetermined period based in part upon a worst case assumption (i.e., an assumption that a train having the greatest possible weight is traveling at a maximum allowable or possible speed in a downhill direction on a portion of track with the steepest grade in the system). In other embodiments, the timeout period is based on the actual speed and weight of the train and the grade of the track between the train and the device. In still other embodiments, the calculation may take into account the distribution of weight in the train. This will affect the required stopping distance as discussed in the aforementioned co-pending U.S. patent application. Alternatively, a minimum distance that represents the minimum separation from the train to the wayside status device may be calculated. A 'good' response to the interrogation signal must be received before this minimum distance is reached, or an error will be declared.

If the device 180 responds to the interrogation within the timeout period (or before the minimum distance is reached) at step 220 and reports a 'good' status (meaning that the device reports that it is functioning properly and that it is safe for the train to proceed through the area associated with the device 180) at step 222, the control module 110 determines the train's current position at step 226. If the train has not passed the wayside status device 180 at step 226, the control module 110 returns to step 216 to repeat the interrogation. If the device 180 has been passed at step 226, the control module 110 returns to step 210 to repeat the process for the next wayside status device 180. Returning to step 216 to interrogate the device multiple times as the train approaches the device is important for safety purposes. This will detect malfunctions or changes after the initial interrogation (e.g., someone throwing the switch into the wrong position after the initial interrogation but before the train reaches the switch, or a grade crossing gate being raised after the initial interrogation but before the train has passed the grade crossing) from causing an accident. Whether or not the interrogation of step 216 includes the wayside status device's identification number, it is preferable for the wayside status device's response to include its identification number as this allows for greater assurance that a response from some other source has not been mistaken as a response from the device.

If a wayside status device 180 does not respond at step 220 or reports a status indicative of a problem at step 222 after being interrogated at step 216, the control module 110 warns the engineer/operator of the problem via the pendant 170 at step 230. A second time period within which the operator must acknowledge the warning and slow the train to a reduced speed is associated with the warning. This time period may be a predetermined number based on a worst-case stopping distance, or may be calculated dynamically based on factors such as the current speed of the train, the braking characteristics of the brakes on the train, the weight of the train, the distribution of weight on the train, and/or the grade of the track as determined from the map database 130 using the train position from the positioning system 120, or other factors as discussed in the above-referenced co-pending U.S. patent application.

If the conductor/engineer fails to acknowledge the warning at step 232 within the second time period, the control module 110 commands the brake interface to stop the train at step 242. The control module 110 then notifies the dispatcher of the stopped train at step 244.

If the operator acknowledges the warning at step 232 and sufficiently slows the train at step 234 within the allowable time period, the control module 110 monitors the speed of the train to ensure that the reduced, safe speed is maintained at step 235 until (1) the conductor/engineer indicates, by pressing a button on the pendant 170, that he has visually verified that the wayside status device is malfunctioning and that it is safe to proceed, or (2) the train has passed the area monitored by the device 180 at step 337. For example, in the case of a wayside status device 180 such as a grade crossing gate, if the control module 110 does not receive a status message, or receives a status message indicating that the gate is up or that there is some malfunction with the gate, the control module 110 will allow the train to approach the grade crossing at a slow speed until the engineer/operator verifies that it is safe to proceed (which indicates that the gate is in the down position and that there is a malfunction in the status reporting function of the wayside device) or, if the gate is not down (which indicates a malfunction in the operational portion of the device), until the train completely passes the grade crossing.

Upon receiving an indication from the operator that it is safe to proceed at step 236 or the area of track associated with the device 180 has been passed at step 337 (both of which are indications that the device is malfunctioning), the control module 110 displays the malfunction to the engineer/operator at step 238. This allows the engineer/operator to review the determination of a malfunction of the wayside status device 180. If the engineer/operator confirms that the malfunction is to be reported at step 239, the malfunction is reported to the dispatcher 190 at step 240. Steps 210 et seq. are then repeated.

At step 222 above, the control module 110 determines whether the device 180 reports a good status. This determination is necessarily device dependent. For example, in the case of a switch, the determination as to whether the device is configured correctly is preferably made with respect to warrants/authorities and/or route information issued to the train. That is, the database 130 preferably stores information as to what route the train is to take and information as to how switches are to be configured. Preferably, the database 130 also stores information as to the type of switch, such as whether a switch is a self-aligning switch. This allows the controller 110 to recognize that a trailing point switch that indicates it is in an "incorrect" position (as determined from the route/configuration information stored in the database 130) is not an error condition since a self aligning switch will align itself to the correct position once the train passes. In the case of a grade crossing gate, determining that the device is configured properly comprises more than determining that the gate is in the down position. Many such devices are designed such that a failure results in the gate being placed in the down position. Thus, the status device can indicate that the gate is in the down position but also indicate a malfunction nonetheless.

As discussed above, faults are reported in the preferred embodiment by transmitting a message to a central authority as soon as it has been determined that a fault has occurred. However, this will not always be possible. For example, some systems include sections of track that are outside the communications range of the transceiver 150. There may be temporary disruptions in the communications system. Also, some embodiments do not provide for communications between the system and a central authority. In such systems and/or under such circumstances, alternative methods for communicating faults to maintenance personnel are possible. In one method, applicable to a system in which communications with a central authority is provided for, the controller 110 periodically attempts to reestablish communication with the central authority and transmits all faults not previously reported when communications are re-established. In another method, the controller 110 outputs a listing of faults to a printer (not shown in FIG. 1) or to a storage medium such as a floppy disk, and the operator is responsible for providing the paper copy or storage medium to the central authority. In yet another embodiment, the faults are stored by the controller 110 until accessed (e.g., downloaded from the controller 110 or displayed on the operator pendant 170 when a corresponding command is entered) by maintenance personnel at a convenient time, such as when the train reaches a train yard.

It should be understood that, in some embodiments, some wayside status devices 180 may be configured by sending commands from the train. In such embodiments, the control module 110 will send the appropriate command via the transceiver 150 on the train to the device 180 via its transceiver 185.

In some embodiments of the invention, a wayside status device is interrogated as the train approaches. However, the invention is not limited to such embodiments. In some other embodiments, wayside devices continuously or periodically transmit information regardless of whether a train is close enough to receive such information. In yet other embodiments, wayside devices detect when a train is approaching (using, e.g., track circuits or radar detectors) and transmit status information at that time. In still other embodiments, a central authority tracks movement of trains and commands the wayside devices to transmit the status information when a train is approaching. Other techniques for triggering the transmission of status information from wayside devices are also possible and within the scope of the invention.

In the embodiments discussed above, the control module 110 is located on the train. It should also be noted that some or all of the functions performed by the control module 110 could be performed by a remotely located processing unit such as a processing unit located at a central dispatcher. In such embodiments, information from devices on the train (e.g., the brake interface 160) is communicated to the remotely located processing unit via the transceiver 150.

Obviously, numerous modifications and variations of the present invention are possible in light of the above teachings. It is therefore to be understood that within the scope of the appended claims, the invention may be practiced otherwise than as specifically described herein.

What is claimed is:

1. A system for reporting faults, the system comprising:

a controller; and a receiver, the receiver being located on a train and being in communication with the controller;

wherein the controller is configured to perform the steps of determining that the train is near a wayside status device;

listening for status information from the wayside status device;

reporting a wayside status device failure if no status information is received from the wayside status device;

if status information is received and the status information indicates a problem, allowing the train to proceed at a speed sufficiently slow to allow an operator to visually determine that proceeding is safe until the operator indicates that the status information is incorrect or until the train passes an area monitored by the wayside status device; and reporting a fault in the status information if the operator indicates that the status information is incorrect or the train passes the area monitored by the wayside status device.

2. The system of claim 1, wherein the wayside status device is a grade crossing gate.

3. The system of claim 1, wherein the wayside status device is a switch.

4. The system of claim 1, wherein the wayside status device is a broken rail detection circuit.

5. The system of claim 1, wherein the wayside status device is a track occupancy circuit.

6. The system of claim 1, wherein the wayside status device is an avalanche detection circuit.

7. The system of claim 1, where in the wayside status device is a bridge alignment circuit.

8. The system of claim 1, further comprising a transmitter connected to the controller, wherein the controller is configured to perform the step of transmitting an interrogation signal to the wayside status device.

9. The system of claim 8, wherein the interrogation signal includes an identification number of the wayside status device.

10. The system of claim 1, further comprising a transmitter connected to the controller, wherein the controller is configured to perform the step of reporting a fault by transmitting a fault message to a central authority.

11. The system of claim 10, further comprising a display device connected to the controller, wherein the controller is further configured to perform the step of displaying the fault to the operator before performing the step of transmitting the fault message.

12. The system of claim 11, further comprising an input device connected to the controller, wherein the controller is further configured to perform the step of accepting via the input device an indication from an operator that it is permissible to send the fault message before performing the step of transmitting the fault message.

13. The system of claim 1, further comprising a printer connected to the controller, wherein the controller is further configured to perform the step of reporting the fault by printing a fault message using the printer.

14. The system of claim 1, further comprising a storage device connected to the controller, wherein the controller is further configured to perform the step of reporting the fault by storing a fault message on the storage device.

15. The system of claim 14, wherein the storage device includes a removable storage medium.

16. The system of claim 1, further comprising a positioning system connected to the controller, wherein the controller is further configured to perform the step of determining a position of the train using the positioning system.

17. The system of claim 16, further comprising a database connected to the controller, the database including location information pertaining to the wayside status device, wherein the controller is configured to perform the step of determining when the train is near a wayside status device using the position determined from the positioning system and the location information pertaining to the wayside status device.

18. An automated method for reporting faults on a train comprising the steps of:

determining that the train is near a wayside status device;

listening for status information from the wayside status device;

reporting a wayside status device failure if no status information is received from the wayside status device;

if status information is received and the status information indicates a problem, allowing the train to proceed at a speed sufficiently slow to allow an operator to visually determine that proceeding is safe until the operator indicates that the status information is incorrect or until the train passes an area monitored by the wayside status device; and reporting a fault in the status information if the operator indicates that the status information is incorrect or the train passes the area monitored by the wayside status device;

wherein the determining, listening, allowing, and both reporting steps are performed by a control device.

19. The method of claim 18, wherein the wayside status device is a grade crossing gate.

20. The method of claim 18, wherein the wayside status device is a switch.

21. The method of claim 18, wherein the wayside status device is a broken rail detection circuit.

22. The method of claim 18, wherein the wayside status device is a track occupancy circuit.

23. The method of claim 18, wherein the wayside status device is an avalanche detection circuit.

24. The method of claim 18, where in the wayside status device is a bridge alignment circuit.

25. The method of claim 18, further comprising the step of transmitting an interrogation signal to the wayside status device.

26. The method of claim 25, wherein the interrogation signal includes an identification number of the wayside status device.

27. The method of claim 18, wherein the step of reporting a fault is performed by transmitting a fault message to a central authority.

28. The method of claim 27, further comprising the step of displaying the fault to the operator before performing the step of transmitting the fault message.

29. The method of claim 27, further comprising the step of accepting an indication from an operator that it is permissible to send the fault message before performing the step of transmitting the fault message.

30. The method of claim 29, further comprising the step of reporting the fault by printing a fault message using the printer.

31. The method of claim 18, wherein the step of reporting the fault is performed by storing a fault message on the storage device.

32. The method of claim 31, wherein the storage device includes a removable storage medium.

33. The method of claim 18, further comprising the step of determining a position of the train using a positioning system.

34. The method of claim 33, further comprising the step of determining when the train is near a wayside status device using the position determined from the positioning system and the location information pertaining to the wayside status device obtained from a database of location information.

35. An automated method for reporting faults comprising the steps of:

determining that a train is approaching a wayside status device;

receiving status information from the wayside status device; and if status information is received and indicates that there is a problem, allowing the train to proceed past an area associated with the wayside status device at a speed sufficiently slow to allow an operator to determine that it is safe for the train to proceed and reporting a fault in the status information if the train passes the area or the operator indicates that the status information is incorrect;

wherein the determining, receiving, allowing and reporting steps are performed by a control device.

36. A system for reporting wayside status device faults comprising:

a receiver;

a transmitter; and a control unit connected to the receiver and the transmitter, the control unit being configured to perform the steps of listening for status information from a wayside status device with the receiver;

transmitting via the transmitter a message indicating a failure of the wayside status device to transmit status information if no status information is received from the wayside status device;

transmitting via the transmitter a message indicating an unsafe condition if status information received from the wayside status device correctly indicates an unsafe condition;

transmitting via the transmitter a message indicating that the wayside status device is incorrectly transmitting status information if status information received from the wayside status device incorrectly indicates an unsafe condition.

* * * * *